US009228580B2

(12) United States Patent
Miyazaki et al.

(10) Patent No.: US 9,228,580 B2
(45) Date of Patent: Jan. 5, 2016

(54) FLUID TRANSPORTER AND FLUID TRANSPORTER DRIVING METHOD

(71) Applicant: SEIKO EPSON CORPORATION, Tokyo (JP)

(72) Inventors: Hajime Miyazaki, Matsumoto (JP); Kazuo Kawasumi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/058,126

(22) Filed: Oct. 18, 2013

(65) Prior Publication Data

US 2014/0044565 A1 Feb. 13, 2014

Related U.S. Application Data

(63) Continuation of application No. 13/178,442, filed on Jul. 7, 2011, now Pat. No. 8,926,297.

(30) Foreign Application Priority Data

Jul. 30, 2010 (JP) ..... 2010-171618

(51) Int. Cl.
*F04B 43/12* (2006.01)
*F04B 43/08* (2006.01)

(52) U.S. Cl.
CPC ..... *F04B 43/12* (2013.01); *F04B 43/082* (2013.01)

(58) Field of Classification Search
CPC ..... F04B 43/12; F04B 43/082
USPC ..... 417/474–477.14; 604/153
See application file for complete search history.

(56) References Cited

U.S. PATENT DOCUMENTS

| | | | | |
|---|---|---|---|---|
| 4,746,279 | A | 5/1988 | Manella | |
| 4,910,682 | A * | 3/1990 | Wolff et al. | 702/46 |
| 6,102,678 | A | 8/2000 | Peclat | |
| 6,395,513 | B1 * | 5/2002 | Foster | A61K 38/4886 435/69.1 |
| 6,918,748 | B2 | 7/2005 | Miyazawa | |

(Continued)

FOREIGN PATENT DOCUMENTS

| | | |
|---|---|---|
| JP | 2001-515557 | 9/2001 |
| JP | 2003-035281 | 2/2003 |

(Continued)

OTHER PUBLICATIONS

Machine Translation of Japanese Patent JP 2004092537 A to Kikuchi et al provided in Applicant's IDS of Jun. 10, 2014.*

*Primary Examiner* — Peter J Bertheaud
*Assistant Examiner* — Dnyanesh Kasture
(74) *Attorney, Agent, or Firm* — Workman Nydegger

(57) ABSTRACT

A fluid transporter which transports fluid by pressing a plurality of radially disposed pressing shafts against a tube held in a circular-arc shape in directions from the inside of the circular-arc shape in accordance with rotation of a rotational pressing plate having a plurality of projections on the outer circumference thereof so as to allow flow of fluid includes: a first detecting section which detects the rotation angle of the rotational pressing plate; a second detecting section which detects the rotation angle of either a driving rotor for giving a rotational force to the rotational pressing plate or a reduction transmission mechanism for connecting the driving rotor and the rotational pressing plate; a data table which shows the relationship between the rotation angle of the rotational pressing plate and a cumulative delivery amount; and a controller which controls the drive of the driving rotor.

2 Claims, 7 Drawing Sheets

(56) References Cited

U.S. PATENT DOCUMENTS

| | | | | |
|---|---|---|---|---|
| 7,534,099 | B2 | 5/2009 | Knauper et al. | |
| 2005/0069436 | A1 | 3/2005 | Shibasaki | |
| 2007/0296744 | A1 | 12/2007 | Kubota et al. | |
| 2008/0031740 | A1 | 2/2008 | Miyazaki et al. | |
| 2008/0138218 | A1 | 6/2008 | Miyazaki et al. | |
| 2008/0138222 | A1* | 6/2008 | Miyazaki et al. | 417/474 |
| 2009/0060755 | A1 | 3/2009 | Miyazaki | |
| 2009/0208350 | A1 | 8/2009 | Miyazaki et al. | |
| 2010/0047099 | A1 | 2/2010 | Miyazaki et al. | |
| 2010/0080720 | A1 | 4/2010 | Miyazaki et al. | |
| 2010/0143168 | A1 | 6/2010 | Miyazaki et al. | |
| 2011/0034900 | A1* | 2/2011 | Yodfat et al. | 604/500 |
| 2013/0287606 | A1 | 10/2013 | Miyazaki et al. | |

FOREIGN PATENT DOCUMENTS

| | | |
|---|---|---|
| JP | 2004-092537 | 3/2004 |
| JP | 2010-077947 | 4/2010 |
| WO | 97/34084 | 9/1997 |

* cited by examiner

FLUID TRANSPORTER AND FLUID TRANSPORTER DRIVING METHOD

CROSS REFERENCES TO RELATED APPLICATIONS

This application is a Continuation of application Ser. No. 13/178,442, filed Jul. 7, 2011, which is expressly incorporated herein by reference in its entirety. The entire disclosure of Japanese Patent Application No. 2010-171618, filed Jul. 30, 2010, is expressly incorporated herein by reference.

BACKGROUND

1. Technical Field

The present invention relates to a fluid transporter which delivers a small quantity of fluid at a low speed, and a method for driving this fluid transporter.

2. Related Art

A peristaltic pump is known as a device for transporting liquid at a low speed. Examples of the peristaltic pump include a type which sequentially presses an elastic tube as a fluid transportation channel from the upstream side to the downstream side by using a plurality of fingers operated in accordance with the drive of a cam unit such that liquid can be pushed out of the tube for delivery therefrom by the press of the plural fingers against the tube for closure of the tube (for example, see JP-T-2001-515557).

According to the pump which delivers fluid by the press of the plural fingers against the tube for closure thereof as in the disclosure of JP-T-2001-515557, the rotation angle of the cam unit and the delivery amount exhibit a non-linear relationship. Therefore, errors are produced in the delivery amount when the delivery amount is controlled only by the rotation angle, which makes it difficult to control the delivery amount with high accuracy. However, particularly in case of injection of a liquid medicine into a living body, accurate control over the delivery amount is required.

Moreover, when the cam unit is started from an arbitrary rotation position at the time of priming (initial injection of liquid medicine), an accurate delivery amount of the liquid medicine is difficult to be provided.

Furthermore, the inside diameter of the elastic tube (diameter of fluid flow section) has manufacturing variations. Thus, even under the same driving condition, the delivery amount may be varied according to the variations of the inside diameter of the tube.

SUMMARY

An advantage of some aspects of the invention is to provide a technology capable of solving at least a part of the aforementioned problems and the invention can be implemented as the following forms or application examples.

Application Example 1

This application example of the invention is directed to a fluid transporter including: a reservoir which contains fluid; an elastic tube which communicates with the reservoir; a tube guide wall which holds the tube in a circular-arc shape; a rotational pressing plate which is disposed inside with respect to the position of the tube and has n number of projections on the outer circumference of the rotational pressing plate; and a plurality of pressing shafts disposed between the tube and the rotational pressing plate and extended radially from a rotation center of the rotational pressing plate, and transports the fluid by sequentially pressing the plural pressing shafts in the flowing direction of the fluid by means of the projections and repeatedly closing and opening the tube. The fluid transporter further includes: a driving rotor which gives a rotational force to the rotational pressing plate; a reduction transmission mechanism which connects the driving rotor and the rotational pressing plate; a first detecting section which detects the rotation angle of the rotational pressing plate; a second detecting section which detects the rotation angle of either the driving rotor or the reduction transmission mechanism; a data table which shows the relationship between the rotation angle of the rotational pressing plate and a cumulative delivery amount; and a controller which controls the drive of the driving rotor such that the driving rotor rotates to a rotation position corresponding to a designated cumulative delivery amount by comparing the rotation angle of the rotational pressing plate obtained by the first detecting section and the second detecting section with the data table.

According to this fluid transporter, the projections press the plural pressing shafts in accordance with the rotation of the rotational pressing plate, whereby the plural pressing shafts perform peristaltic movement to close the tube and deliver the fluid. In this case, only a small quantity of the fluid reversely flows after release of the engagement between the projections and the pressing shafts and restoration of the tube to the original shape. As a result, the change in the fluid delivery amount with respect to the rotation angle of the rotational pressing plate exhibits a non-linear change within one cycle from the press start of the projections against the pressing shafts to the release of the engagement. Thus, the delivery amount cannot be accurately controlled only by detection of the rotation degree of the rotational pressing plate.

In this application example of the invention, therefore, the data table showing the relationship between the rotation angle of the rotational pressing plate and the cumulative delivery amount measured beforehand is prepared. Thus, the cumulative delivery amount can be accurately controlled by comparing the rotation angle of the rotational pressing plate detected by the first detecting section and the second detecting section with the data table, and rotating the rotational pressing plate to the rotation position corresponding to the designated cumulative delivery amount (desired delivery amount).

Moreover, the driving rotor and the rotational pressing plate are connected with each other by the reduction transmission mechanism. When the reduction ratio is 1/40, for example, the resolution for rotation detection of the rotational pressing plate becomes 40 times higher than the resolution for the rotation angle of the driving rotor detected by the second detecting section. In this case, the change of the delivery amount corresponding to the small angle change of the rotational pressing plate can be controlled. Thus, a highly accurate amount can be delivered.

Application Example 2

It is preferable that the controller in the fluid transporter according to the above application example detects the rotation angle of the rotational pressing plate from a rotation reference position determined as a position where the detection timing obtained by the first detecting section and the detection timing obtained by the second detecting section agree with each other.

For matching the detection timing obtained by the first detecting section with the detection timing obtained by the second detecting section, the rotation detection resolution of the second detecting section is set an integral number times higher than the rotation detection resolution of the first detecting section. In this case, the position detected by the first detecting section is determined as the rotation reference position, and the rotation angle of the driving rotor is detected by the second detecting section from this position. By this method, the cumulative delivery amount corresponding to the rotation angle of the rotational pressing plate can be controlled with high resolution.

Application Example 3

It is preferable that the rotational pressing plate in the fluid transporter of the application example has the same number of the rotation reference positions as the number of the projections in the circumferential direction, and that the data table is prepared in the range from a position corresponding to one of the rotation reference positions to a position corresponding to 360/n degrees.

When the number of the projections is four, for example, each division has 360/n=90 degrees. In this case, the range shown by the data table is only required to include the cumulative delivery amounts in the range from 0 degree to 90 degrees of the rotation angle of the rotational pressing plate. Thus, the data table can be simplified. When the rotation angle is larger than 90 degrees, the rotation angle is considered as the sum of the multiple of 90 degrees and the detected rotation angle. When the rotation angle is 360 degrees (one rotation) or larger, the detected rotation angle is added to the multiple of 90 degrees.

Application Example 4

It is preferable that the data table in the fluid transporter of the above application example contains values of cumulative delivery amounts corrected based on the difference between a reference inside diameter and an actual inside diameter of the tube.

Generally, the fluid delivery amount of a peristaltic type fluid transporter per unit time depends on the inside diameter (cross-sectional area) of a tube and the rotation speed of a rotational pressing plate. It is also known that the tube inside diameter has manufacturing variations. According to this application example of the invention, the data table uses the cumulative delivery amounts corrected based on the difference between the reference inside diameter (designed inside diameter) and the actual inside diameter of the tube. Thus, variations in the delivery amount caused by changes of the tube inside diameter can be reduced.

Application Example 5

It is preferable that the fluid transporter of the above application example includes a drive control unit having the rotational pressing plate, the driving rotor, the reduction transmission mechanism, the first detecting section, and the second detecting section as one body, and a tube unit having the tube, the plural pressing shafts, and the reservoir as one body, the drive control unit and the tube unit being attachable and detachable to and from each other.

According to this structure, the drive control unit and the tube unit are attachable and detachable to and from each other. Thus, after the end of fluid delivery, the tube unit containing new fluid can be attached to the drive control unit to restart fluid delivery in a short time.

Moreover, the drive control unit which includes a larger number of components and is thus expensive can be repeatedly used. On the other hand, the tube unit which includes a smaller number of components and is thus less expensive than the drive control unit can be used as a disposable unit. In this case, the running cost can be lowered.

Furthermore, when the liquid is a liquid medicine for used medical treatment or other purposes, it is considered that the tube comes into contact with blood or the like. In this case, the level of safety increases when the tube unit is a disposable unit.

Application Example 6

This application example of the invention is directed to a method for driving a fluid transporter which includes an elastic tube, a tube guide wall which holds the tube in a circular-arc shape, a rotational pressing plate which is disposed inside with respect to the position of the tube and has n number (n: two or larger integer) of projections on the outer circumference of the rotational pressing plate, a plurality of pressing shafts disposed between the tube and the rotational pressing plate and extended radially from a rotation center of the rotational pressing plate, a driving rotor which gives a rotational force to the rotational pressing plate, a reduction transmission mechanism which connects the driving rotor and the rotational pressing plate, a first detecting section which detects a rotation reference position of the rotational pressing plate, a second detecting section which detects the rotation angle of either the driving rotor or the reduction transmission mechanism, and a data table which shows the relationship between the rotation angle of the rotational pressing plate and a cumulative delivery amount. The method includes: rotating the rotational pressing plate, and stopping the rotation when the first detecting section detects the rotation angle of the rotational pressing plate to initialize the cumulative delivery amount and the rotation angle of the driving rotor; rotating the rotational pressing plate to start fluid delivery; allowing the second detecting section to detect the rotation angle of the rotational pressing plate and comparing the detected rotation angle with the data table; and rotating the rotational pressing plate through a rotation angle corresponding to a designated cumulative delivery amount and stopping fluid delivery when the rotation angle of the rotational pressing plate reaches the rotational angle corresponding to the designated cumulative delivery amount.

According to the driving method of this application example, the data table which shows the relationship between the rotation angle of the rotational pressing plate and the cumulative delivery amount practically measured beforehand is provided. In this case, the cumulative delivery amount can be accurately controlled by comparing the rotation angle of the rotational pressing plate detected by the first detecting section and the second detecting section with the data table and rotating the rotational pressing plate to the rotation position corresponding to the designated cumulative delivery amount.

When the rotational pressing plate (projections) of the fluid transporter of the above application example used for injection of a liquid medicine is started from an arbitrary rotation position at the time of priming (initial injection of liquid medicine), an accurate delivery amount is difficult to be provided because the position of the rotational pressing plate is not recognized. According to this application example of the invention, however, the rotational pressing plate is started from the rotation reference position determined in advance (rotation angle: 0 degree, cumulative delivery amount: 0 μl). Thus, an accurate amount can be delivered.

Moreover, at the start of the fluid transporter, the rotational pressing plate is rotated to the rotation reference position and stopped thereat. Then, delivery is started from the rotation reference position. By this method, the correlation between the rotation position and the cumulative delivery amount can be obtained from the first of the data table.

Furthermore, the driving rotor and the rotational pressing plate are connected with each other via the reduction transmission mechanism. In this case, the resolution for rotation detection of the rotational pressing plate can resolve an angle smaller than an angle resolved by the resolution for rotation detection of the driving rotor by the reduction ratio. Accordingly, the change of the delivery amount corresponding to the change of the small angle of the rotational pressing plate can be controlled, whereby a more accurate amount can be delivered.

Application Example 7

This application example is directed to a method for driving a fluid transporter which includes an elastic tube, a tube guide wall which holds the tube in a circular-arc shape, a rotational pressing plate which is disposed inside with respect to the position of the tube and has n number (n: two or larger integer) of projections on the outer circumference of the rotational pressing plate, a plurality of pressing shafts disposed between the tube and the rotational pressing plate and extended radially from a rotation center of the rotational pressing plate, a driving rotor which gives a rotational force to the rotational pressing plate, a reduction transmission mechanism which connects the driving rotor and the rotational pressing plate, a first detecting section which detects a rotation reference position of the rotational pressing plate, a second detecting section which detects the rotation angle of either the driving rotor or the reduction transmission mechanism, and a data table which shows the relationship between the rotation angle of the rotational pressing plate and a cumulative delivery amount. The method includes: inputting a delivery stop instruction in the course of fluid delivery to stop the delivery; and storing the rotation position of the driving rotor from the rotation reference position at the time of the delivery stop.

There is a case in which fluid delivery is desired to be stopped before the cumulative delivery amount reaches the predetermined cumulative delivery amount. In this case, the rotation position of the driving rotor at the time of the delivery stop is stored, and the rotation angle of the driving rotor after the restart of delivery is compared with the data table. By this method, the cumulative delivery amount after the restart of delivery can be accurately detected and controlled.

Application Example 8

It is preferable that the method for driving the fluid transporter according to the above Seventh Aspect further includes: comparing the data table and the rotation angle of the driving rotor and storing the cumulative delivery amount at the time of stopping the delivery.

According to this method, the cumulative delivery amount from the delivery start to the delivery stop is recognized. Also, as noted above, the rotation position of the driving rotor at the time of the stop is recognized. Thus, the shortage of the delivery amount for the cumulative delivery amount established at the initial step of the drive start can be calculated for delivery of the shortage. Alternatively, the additional delivery amount can be newly established after the delivery stop such that the additional amount can be accurately delivered.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments according to the invention are hereinafter described with reference to the drawings. The technology of the invention can be used for a wide variety of applications used for delivering a small amount of fluid at a low speed. In the following embodiments, an example of a fluid transporter which injects a liquid medicine into a living body, and an example of a method for driving this fluid transporter will be discussed. It is assumed, therefore, that the fluid used herein is liquid such as a liquid medicine.

It should be noted that the drawings referred to herein are only schematic figures the reduction scales of which in association with components and parts in the vertical and horizontal directions are different from the actual scales for convenience of explanation.

First Embodiment

Fluid Transporter

Figure 1:
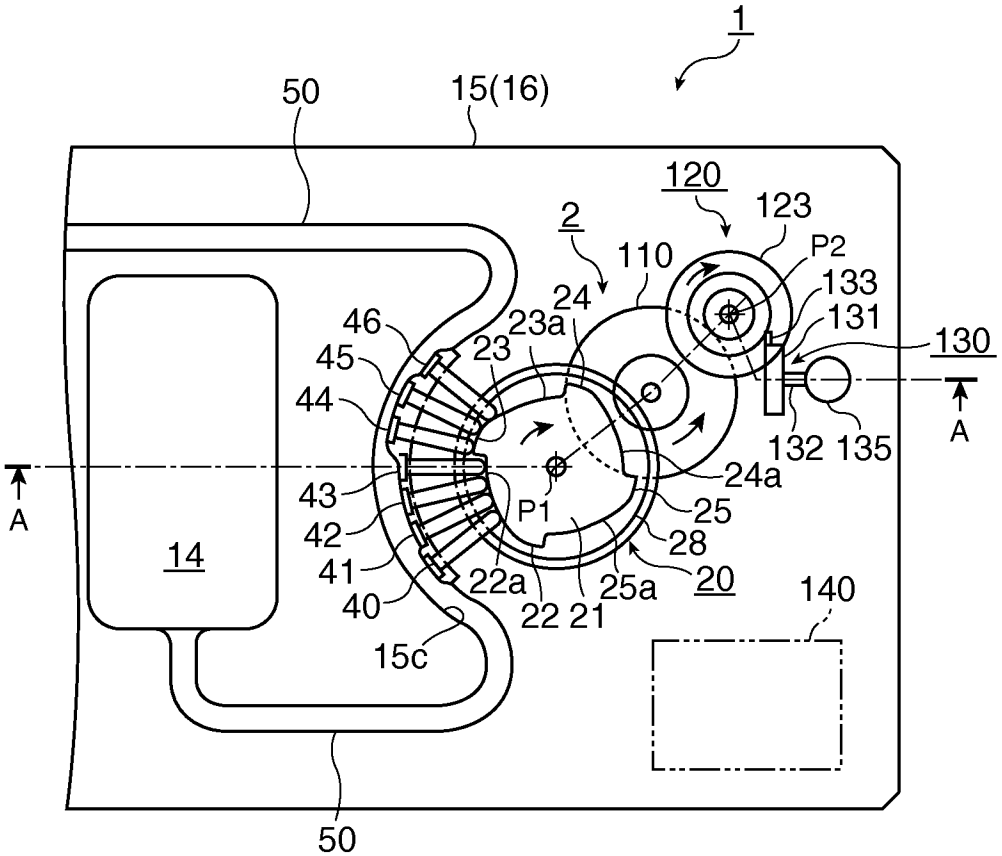
FIG. 1 is a plan view illustrating the general structure of a fluid transporter according to a first embodiment.
Figure 2:
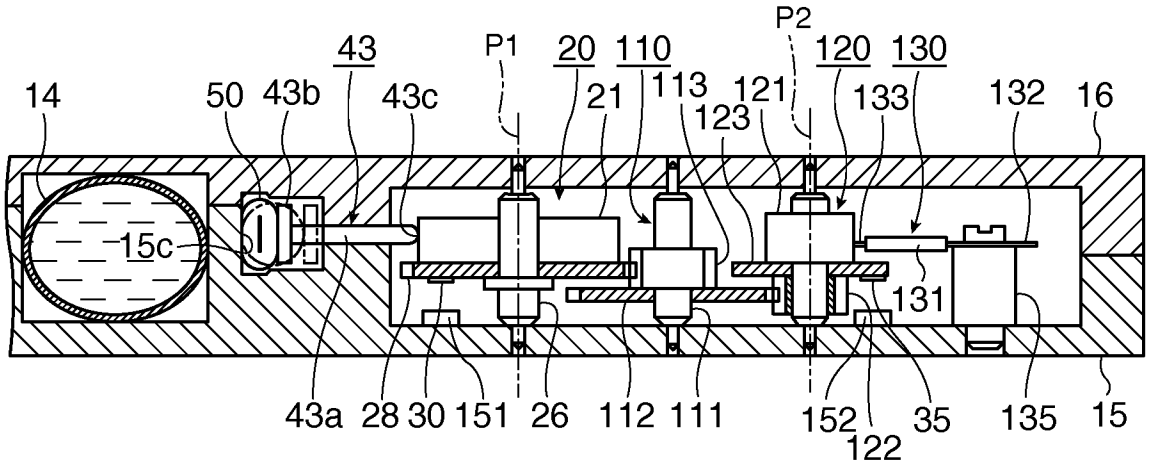
FIG. 2 is a partial cross-sectional view taken along a line A-A in FIG. 1.

FIG. 1 is a plan view illustrating the general structure of a fluid transporter according to a first embodiment. FIG. 2 is a partial cross-sectional view showing a cross section taken along a line A-A in FIG. 1. As illustrated in FIGS. 1 and 2, a fluid transporter 1 includes a reservoir 14 which stores liquid, a tube 50 which has elasticity and communicates with the reservoir 14, fingers 40 through 46 as a plurality of pressing shafts for pressing and closing the tube 50, a cam 20 as a rotational pressing plate which pushes the fingers 40 through 46 toward the tube 50, a driving rotor 120 as a driving source of the cam 20, a reduction transmission mechanism 2 which connects the cam 20 and the driving rotor 120, and a first device frame 15 and a second device frame 16 for holding these components of the fluid transporter 1.

A part of the tube 50 has a circular-arc shape following the circular-arc shape of a tube guide wall 15*c* formed on the first device frame 15. One end of the tube 50 communicates with the reservoir 14, and the other end of the tube 50 is extended to the outside. The center of the circular arc of the tube guide wall 15*c* agrees with a rotation center P1 of the cam 20. The fingers 40 through 46 are disposed between the tube 50 and the cam 20. The fingers 40 through 46 are radially extended at equal angles from the rotation center P1 of the cam 20.

The fingers 40 through 46 have the same shapes, and the shape of the finger 43 is herein explained as an example with reference to FIG. 2. The finger 43 has a bar-shaped shaft portion 43*a*, a flange 43*b* as a flange-shaped portion provided at one end of the shaft portion 43*a*, and a cam contact portion 43*c* as a hemispherical part provided at the other end of the shaft portion 43*a*. In this embodiment, the finger 43 is made of metal or resin having high rigidity. The cross-sectional shape of the finger 43 in the direction perpendicular to the axial direction thereof is circular or quadrangular.

As illustrated in FIG. 2, the cam 20 has a camshaft 26, a cam gear 28 engaging with the cam shaft 26, and a cam body 21, and is supported by the first device frame 15 and the second device frame 16. As illustrated in FIG. 1, the cam body 21 has four projections 22, 23, 24, and 25 on the outer circumference of the cam body 21. The pitches in the circumferential direction and the shapes of the projections 22, 23, 24, and 25 are uniform. The projections 22 through 25 correspond to pressing portions which sequentially press the fingers 40 through 46 from the upstream side to the downstream side. Therefore, the projections 22 through 25 are hereinafter referred to as finger pressing portions. In this description, the side close to the reservoir 14 corresponds to the upstream side, while the side away from the reservoir 14 corresponds to the downstream side.

The cam body 21 has slopes 22*a*, 23*a*, 24*a*, and 25*a* gradually connecting with the areas for opening the fingers 40 through 46 (i.e., opening the tube 50) and with the finger pressing portions 22, 23, 24, and 25.

The structure of the reduction transmission mechanism 2 is now explained with reference to FIGS. 1 and 2. The reduction transmission mechanism 2 includes the cam gear 28, a transmission wheel 110, and a rotor pinion 122 engaging with a rotor shaft 121. The transmission wheel 110 has a transmission wheel section 111 on which a pinion 113 is provided, and a transmission gear 112. The driving rotor 120 has the rotor shaft 121, the rotor pinion 122, and a detection plate 123 engaging with the rotor shaft 121. The transmission wheel 110 and the driving rotor 120 are supported by the first device frame 15 and the second device frame 16 by which the cam 20 is similarly supported. The rotation of the driving rotor 120 is transmitted to the cam 20 at a predetermined reduction ratio via the reduction transmission mechanism 2. According to this embodiment, the reduction ratio is set at 40. In this case, one rotation of the driving rotor 120 corresponds to 1/40 rotation of the cam 20. The driving rotor 120 has a rotation center P2.

An oscillator 130 is a driving source for rotating the driving rotor 120. The oscillator 130 has a piezoelectric element 131, an arm 132, and a convex 133 contacting the side surface of the rotor shaft 121. The arm 132 of the oscillator 130 is fixed to a fixed shaft 135 embedded in the first device frame 15 by a screw. The structure and the driving method employed for the oscillator 130 may be similar to the corresponding structure and driving method of an oscillator disclosed in JP-A-2003-35281 (see FIGS. 3 and 4). Thus, the explanation of those is not repeated herein. The drive of the oscillator 130 is controlled by a driver 141 included in a controller 140 (see FIG. 1).

The structures of the controller 140 and of a first detecting section and a second detecting section are now explained with reference to FIGS. 2 and 3.

Figure 3:
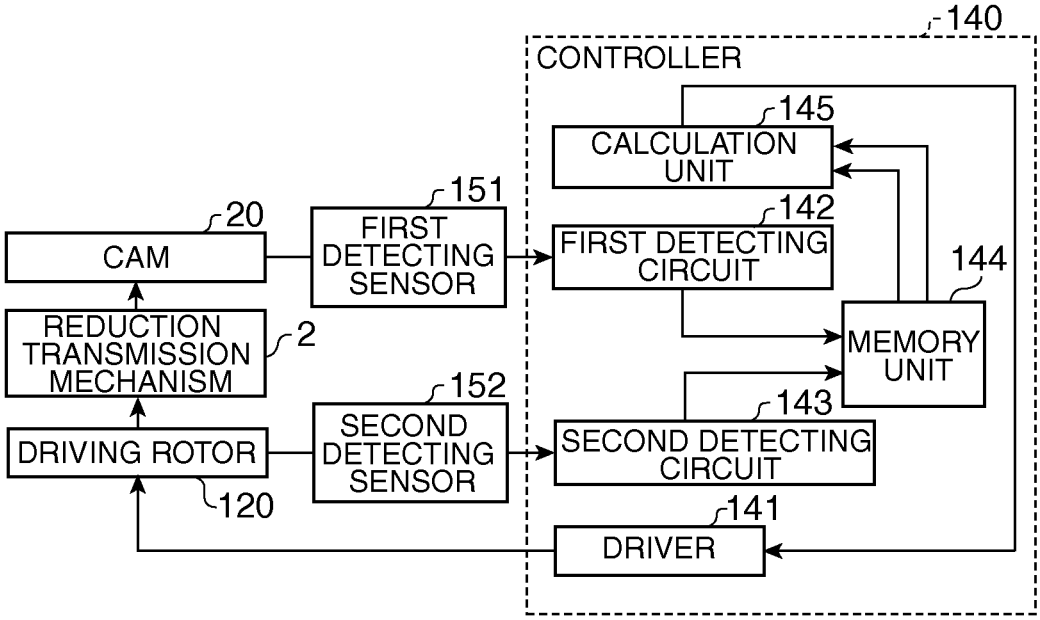
FIG. 3 illustrates the structures of a controller, a first detecting section, and a second detecting section as examples.

FIG. 3 shows the structures of the controller and the first detecting section and the second detecting section as examples. The first detecting section includes a first detecting sensor 151 for detecting the rotation position of the cam 20, and a first detecting circuit 142. The first detecting sensor 151 is an optical type sensor having a light emitting element and a light receiving element (both not shown). Detection markers 30 are provided on the surface of the cam gear 28 opposed to the first detecting sensor 151 such that light emitted from the light emitting element and reflected by the detection markers 30 can be detected by the light receiving element.

The second detecting section includes a second detecting sensor 152 for detecting the rotation angle of the driving rotor 120, and a second detecting circuit 143. The second detecting sensor 152 is an optical type sensor having a light emitting element and a light receiving element (both not shown). Detection markers 35 representing the rotation angle of the driving rotor 120 are provided on the surface of the detection plate 123 opposed to the second detecting sensor 152 such that light emitted from the light emitting element and reflected by the detection markers 35 can be detected by the light receiving element.

The details of the detection markers 30 and the detection markers 35 will be described later with reference to FIGS. 4 and 5. Each of the first detecting sensor 151 and the second detecting sensor 152 is not limited to the reflection type sensor employed in this embodiment but may be a transmission type sensor, or other types of sensor such as a magnetic sensor, an ultrasonic sensor, and other non-contact type and contact type sensors.

The controller 140 includes the first detecting circuit 142, a memory unit 144 which retains data detected by the second detecting circuit 143 and a data table, a calculation unit 145 which calculates the rotation angle of the driving rotor 120 through which angle the cam 20 is rotated to reach the rotation position corresponding to a designated cumulative delivery amount (desired cumulative delivery amount) by comparison with the data table and the detection data, and the driver 141 which drives the oscillator 130 for the calculated time at a predetermined frequency.

The detection markers 30 and the detection markers 35 as examples are now explained with reference to FIGS. 4 and 5.

Figure 4:
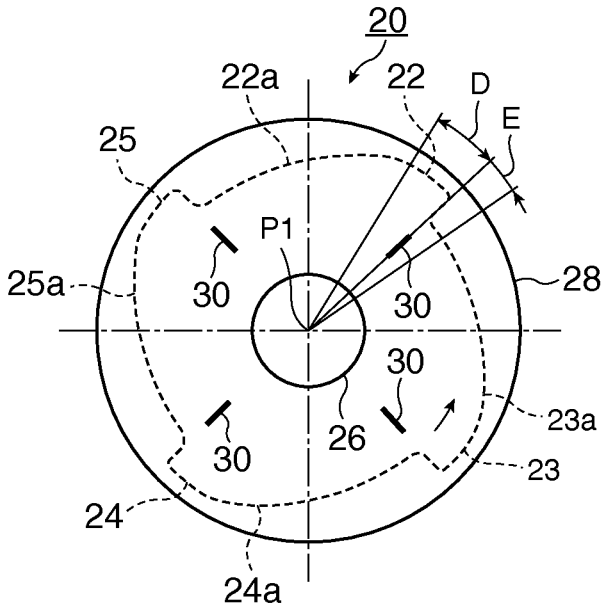
FIG. 4 is a plan view illustrating detection markers representing rotation reference positions of a cam.

FIG. 4 is a plan view illustrating the detection markers representing rotation reference positions of the cam. FIG. 4 shows the surface opposed to the first detecting sensor 151. The detection markers 30 are provided on the surface of the cam gear 28 radially at uniform angle intervals and at uniform distances from the rotation center P1. According to this embodiment, the four detection markers 30 are disposed on four equal parts divided in the circumferential direction with one-to-one correspondence such that the positions of the projections 22 through 25 as the four finger pressing portions can be marked on the cam body 21 by means of the detection markers 30. Thus, the number of the projections agrees with the number of the detection markers 30 (number of divisions), and the angle formed by the adjoining two detection markers 30 is 90 degrees.

The respective tops of the projections 22 through 25 of the cam body 21 are disposed on a concentric circle around the rotation center P1. An area D is an area where the tube 50 is pressed for closure so as not to supply liquid under the closed condition of the tube. An area E is an area where the engagement between the fingers and the projections 22 through 25 is released so as to open the tube 50. It should be noted that the positions of the detection markers 30 are not limited to the positions shown in FIG. 4 but may be other positions as long as they correspond to the four equal divisions.

Figure 5:
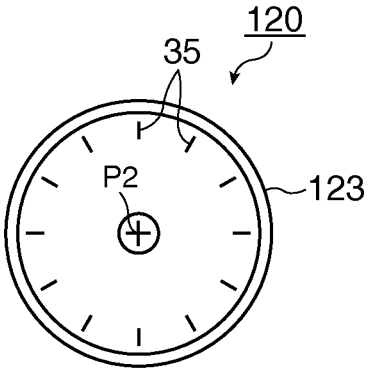
FIG. 5 is a plan view illustrating detection markers representing rotation angles of a driving rotor.

FIG. 5 is a plan view illustrating the detection markers which represent the rotation angles of the driving rotor. The detection markers 35 are provided on the surface of the detection plate 123 radially at uniform angle intervals and at uniform distances from the rotation center P2. In this embodiment, the detection markers 35 are disposed on twelve equal parts divided in circumferential direction with one-to-one correspondence. Thus, the angle formed by the adjoining two detection markers 35 is 30 degrees.

When the reduction ratio for reduction from the driving rotor 120 to the cam 20 is set at 1/40, the cam 20 makes 1/40 rotation (9 degree) during one rotation of the driving rotor 120. Under the condition in which the detection markers 35 are provided on the twelve divisions for each, the resolution for the rotation of the driving rotor 120 is 30 degrees, while the resolution for the rotation of the cam 20 is 30/40=0.75 degree.

It should be noted that the number of divisions of the detection markers 35 is not limited to twelve but may be appropriately determined depending on the required resolution for the angle of the cam 20, or on the reduction ratio or the resolution of the second detecting sensor 152 for angle detection. The number of the divisions of the detection markers 30 is set at the number of the projections, or is set at one. When only the one detection marker 30 is provided, detection is carried out once for one rotation of the cam 20. The number of the detection markers 35 (number of divisions) is set at the number of the detection markers 30 multiplied by an integer.

The position of the second detecting section is not limited to a location around the driving rotor 120 but may be any position on the reduction transmission mechanism 2. For example, the second detecting sensor 152 may be disposed at a position opposed to detection markers provided at the position of the transmission gear 112 of the transmission wheel 110. When the second detection sensor 152 is disposed at this position, the reduction ratio changes accordingly. Thus, the rotational speed of the cam 20, the reduction ratio, and the number of divisions of the detection markers are appropriately determined in accordance with the change.

The detection markers 30 and 35 are made of material capable of reflecting light or absorbing light. Alternatively, the detection markers 30 and 35 may have holes penetrating the cam gear 28 and the detection plate 123.

Liquid Delivery Operation

The liquid delivery operation is now explained with reference to FIG. 1. When a driving signal is inputted from the driver 141 to the piezoelectric element 131, the convex 133 of the oscillator 130 provides elliptic oscillation to rotate the driving rotor 120 clockwise. The rotational force of the driving rotor 120 rotates the cam 20 clockwise via the reduction transmission mechanism 2 at the reduction ratio of 1/40. FIG. 1 shows the condition in which the projection 23 presses the finger 44 to close the tube 50. The fingers 45 and 46 positioned on the slope 23*a* of the cam body 21 do not completely close the tube 50.

The fingers 41, 42, and 43 not yet reaching the slope 22*a* of the cam body 21 open the tube 50. The finger 40 is coming to the initial location of the slope 22*a* as a position still opening the tube 50. Fluid flows into the area where the tube 50 is not closed.

With further clockwise rotation of the cam 20, the fingers 40 through 46 are pressed from the upstream side to the downstream side in the rotation direction of the cam 20. By this rotation, the cycle of closing, opening, and again closing the tube 50 is repeated so that liquid can be transported and delivered in the rotation direction of the cam 20 by utilizing the peristaltic movement of the fingers. The plural fingers are so structured that at least one of the fingers, and more preferably two of the fingers constantly press and close the tube 50.

The relationship between the rotation angle of the cam 20 and the cumulative delivery amount is now explained.

Figure 6:
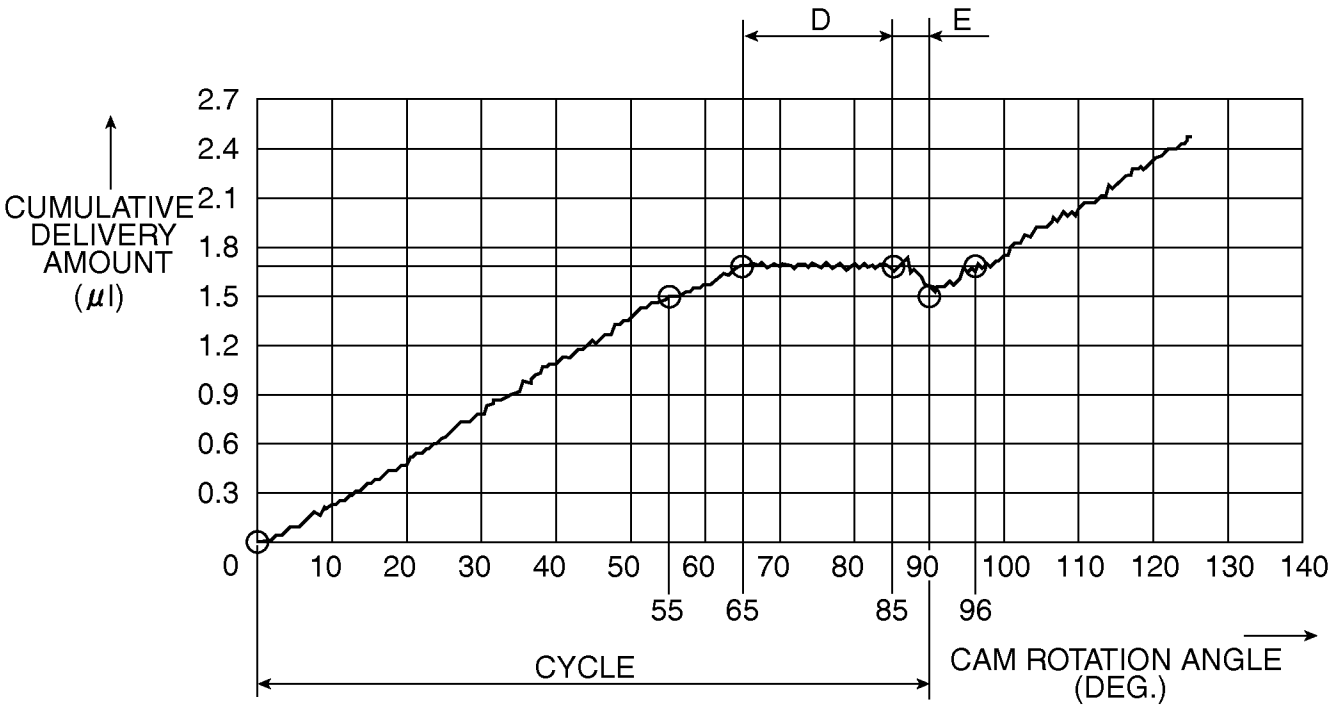
FIG. 6 is a graph showing the relationship between a rotation angle of the cam and a cumulative delivery amount.

FIG. 6 is a graph showing the relationship between the rotation angle of the cam and the cumulative delivery amount. The horizontal axis and the vertical axis of the graph indicate the rotation angle of the cam 20 and the cumulative delivery amount (μl: microliter), respectively. The graph shows the actual measurements of the cam rotation angle and the cumulative delivery amount at a constant cam rotation speed under the condition of the reference inside diameter (designed diameter) of the tube. This graph provides a basis for preparing a data table described later.

With rotation of the cam 20 from a rotation reference position (position where the detection marker 30 is detected: 0 degree), the cumulative delivery amount gradually increases. The cumulative delivery amount at the time of rotation of 65 degrees becomes 1.67 μl. The cumulative delivery amount in the area D from this position to the position of rotation of 85 degrees does not change but is kept substantially constant. This condition corresponds to the state in which the finger 46 rides on the projection 23 of the cam 20 as the range where the closure of the tube 50 is maintained (area D in FIG. 4).

With further rotation of the cam 20 from the rotation position of 85 degrees to the rotation position of 90 degrees, the cumulative delivery amount decreases to 1.5 μl. This condition indicates that 0.17 μl of the delivered liquid has reversely flowed. This reverse flow of liquid is caused when the tube 50 is opened by release of the engagement between the finger 46 located at the downward end and the projection of the cam 20 whereby negative pressure is produced in a part of the volume of the tube 50 closed by the finger 46. With further rotation of the cam 20 from this condition, the inclination of the increase in the cumulative delivery amount becomes similar to the inclination of the increase in the cumulative delivery amount by the rotation from the rotation reference position to 65 degrees.

Thus, for obtaining the cumulative delivery amount of 1.5 μl, the cam 20 needs to rotate through 90 degrees from the rotation reference position. Also, for delivering 1.67 μl as the peak in the figure, the cam 20 needs to rotate through 96 degrees from the rotation reference position. Based on this concept, the cumulative delivery amount can be calculated from the number of the rotation reference positions counted by the first detecting sensor 151 and the delivery amount read from the cam rotation angle smaller than 90 degrees. For example, a cumulative delivery volume V at the position of the cam 20 rotated through 17 degrees from the rotation reference position is expressed by an equation V=1.5 N+0.4 (μl) (N: count number of rotation reference positions).

In practice, what is controlled is the degree of rotation of the cam 20 for the designated cumulative delivery amount (desired delivery amount). In addition, the cam rotation angle is regulated by the number of rotations (rotation angle) of the driving rotor 120. Thus, the cam rotation angle for the cumulative delivery amount is read from FIG. 6, and the rotation angle of the driving rotor necessary for rotation of the cam through the read cam rotation angle is calculated to produce a data table. This data table is herein explained with reference to Table 1 shown below.

Table 1 is an example of the data table. As noted above, the cumulative delivery amount can be expressed in cycles, one cycle of which ranges from the rotation reference position (0 degree) to 90 degrees.

TABLE 1

| CUMULATIVE DELIVERY AMOUNT (μl) | CAM ROTATION ANGLE (DEG.) | DRIVING ROTOR ROTATION ANGLE (DEG.) |
|---|---|---|
| 0.1 | 5.0 | 210 |
| 0.2 | 9.0 | 360 |
| 0.3 | 13.0 | 510 |
| 0.4 | 17.0 | 690 |
| 0.5 | 20.0 | 810 |
| 0.6 | 23.3 | 930 |
| 0.7 | 25.8 | 1032 |
| 0.8 | 30.0 | 1200 |

TABLE 1-continued

| CUMULATIVE DELIVERY AMOUNT (μl) | CAM ROTATION ANGLE (DEG.) | DRIVING ROTOR ROTATION ANGLE (DEG.) |
|---|---|---|
| 0.9 | 33.3 | 1320 |
| 1.0 | 36.0 | 1440 |
| 1.1 | 37.5 | 1500 |
| 1.2 | 43.3 | 1740 |
| 1.3 | 46.7 | 1860 |
| 1.4 | 50.0 | 2010 |
| 1.5 | 90.0 | 3600 |

The data table in this embodiment shows the cam rotation angle necessary for delivering the cumulative delivery amount and the driving rotor rotation angle necessary for rotating the cam through the cam rotation angle for each 0.1 μl of the cumulative delivery amount. For example, the cam rotation angle for 0.1 μl delivery from the rotation reference position is 5 degrees. For rotating the cam 20 through 5 degrees, the driving rotor 120 needs to rotate through 200 degrees when the reduction ratio is 1/40. However, in the structure which provides the detection markers 35 of the driving rotor 120 for each 30 degrees as in this embodiment, the angle of 200 degrees cannot be detected, in which case only the angles of 180 degrees and 210 degrees are detectable. Thus, the angle of 210 degrees closest to 200 degrees is selected, and the driving rotor 120 is rotated through 210 degrees. In this case, the driving rotor 120 is rotated more than the calculated rotation angle by 10 degrees. However, since the reduction ratio is 1/40, the angle of 10 degrees becomes 0.25 degree when converted into the cam rotation angle. This degree corresponds to the delivery amount of 1/100 μl or smaller, and thus is an ignorable volume.

Therefore, each of the rotor rotation angles shown in the data table is an integral number times larger than 30 degrees, and indicates an angle close to the rotation angle calculated from the cam rotation angle and the reduction ratio.

Generally, the liquid delivery amount of a tube-closing peristaltic type fluid transporter per unit time depends on the inside diameter (cross-sectional area) of a tube and the rotation speed of a rotational pressing plate. According to this type of fluid transporter, it is known that the tube inside diameter has manufacturing variations. The data table in Table 1 shows values obtained when the tube inside diameter is a reference inside diameter (designed diameter).

When the reference inside diameter and the actual measurement are d1 mm and d2 mm, respectively, the delivery amount increases by $(d2/d1)^2$. Thus, each of the cumulative delivery amounts in the data table is corrected by $(d2/d1)^2$, and the cam rotation angle and the driving rotor rotation angle necessary for the cam rotation angle in the data table are revised to reflect the correction. This change can be made by inputting the actual measurement of the tube inside diameter from an external input unit (not shown) to the calculation unit 145 and correcting the rotation angle of the driving rotor at the time of comparison between the data table and the designated cumulative delivery amount. Alternatively, the data table may be revised to reflect the correction after the actual measurement of the tube inside diameter is inputted from the external input unit to the calculation unit, or the actual measurement or the corrected value of the tube inside diameter may be inputted to the memory unit 144 for the revise of the data table.

Fluid Transporter Driving Method

A method for driving the fluid transporter according to this embodiment is hereinafter described with reference to the drawings.

Figure 7:
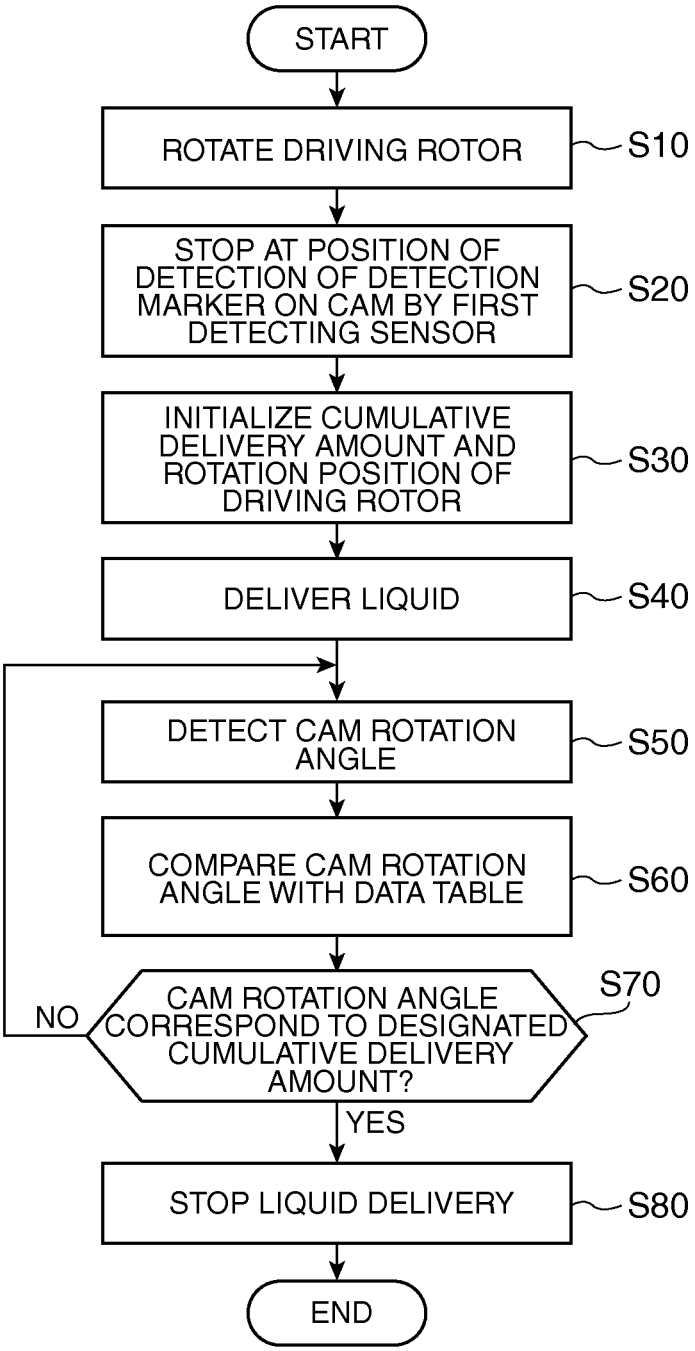
FIG. 7 shows chief steps of a method for driving the fluid transporter according to the first embodiment.

FIG. 7 shows chief steps of a method for driving a fluid transporter according to the first embodiment. This method will be explained in conjunction with FIGS. 1 through 6 as well. Initially, the specific value of the designated cumulative delivery amount is inputted to the controller 140, whereby the driving rotor 120 starts rotation (S10). Then, the driving rotor 120 is stopped at the position where one of the detection markers 30 on the cam 20 is detected by the first detecting sensor 151 (S20). The position of the cam 20 at this time is determined as the rotation reference position (0 degree), whereupon the calculation unit 145 initializes the cumulative delivery amount to 0 μl and the cam rotation position to 0 degree (S30). The value of the designated cumulative delivery amount may be inputted after the step S30 (S30).

Under this condition, the fluid transporter 1 is attached to an injection target (such as a living body) to start operation of the driving rotor 120 and initiate liquid delivery (S40). Detection of the rotation angle of the cam 20 is started from the time when liquid delivery is initiated (rotation reference position) (S50). The rotation angle of the cam 20 is calculated by detection of the detection markers 35 provided on the driving rotor 120 via the second detecting sensor 152, conversion from the counted number of detection into an angle, and multiplication of the angle by the reduction ratio.

Then, the rotation angle of the cam 20 is compared with the data table with liquid delivery continued (S60). For example, when it is determined that the rotation angle of the cam 20 is 17 degrees by detection (corresponding to 690 degrees as the rotation angle of the driving rotor 120, i.e., one rotation and 330 degrees) under the condition of the designated cumulative delivery amount set at 1 μl, the current cumulative delivery amount can be determined as 0.4 μl from the data table.

Then, it is determined whether the cam rotation angle has reached the angle corresponding to the designated cumulative delivery amount by comparison between the data table and the cam rotation angle (S70). According to this embodiment, it is determined that the rotation angle is short by 19 degrees for the cam rotation angle of 36 degrees corresponding to the designated cumulative delivery amount of 1.0 μl (cumulative delivery amount is short by 0.6 μl). In this case, fluid delivery is continued to repeat the steps S50, S60, and S70. More specifically, the shortage of the rotation angle of the driving rotor 120 is calculated as 750 degrees (two rotations and 30 degrees) based on the fact that the rotation angle of the driving rotor 120 corresponding to the cam rotation angle of 36 degrees is 1440 degrees, wherefore the driving rotor 120 is further rotated by 750 degrees.

When the designated cumulative delivery amount is 1.5 μl or larger, the necessary cam rotation angle can be similarly calculated by referring to the data table. For example, when the designated cumulative delivery amount is set at 1.9 μl, the cumulative delivery amount of 0.4 μl is short based on the fact that the cam rotation angle of 90 degrees provides the cumulative delivery amount of 1.5 μl. Thus, the cam rotation angle of 17 degrees corresponding to the cumulative delivery amount of 0.4 μl is read from the data table, and the driving rotor 120 is rotated through 4290 degrees (11 rotations and 330 degrees) as the sum of the rotation angle of 690 degrees of the driving rotor 120 and 3600 degrees. In case of the designated cumulative delivery amount set at several hundred μl, a fraction of the rotation angle other than cycles one cycle of which starts from the rotation reference position (0 degree) to 90 degrees is read from the data table, and the rotation angle corresponding to the fraction is added. Accordingly, only one cycle of the data table needs to be prepared.

When it is determined that the cam rotation angle has reached the cam rotation angle corresponding to the designated cumulative delivery amount in the data table, the drive of the driving rotor 120 is stopped to suspend liquid delivery (S80) as an end of liquid delivery.

There is a case in which liquid delivery is desired to be stopped before reaching the designated cumulative delivery amount. A driving method to be employed in this case is now explained with reference to the drawings.

Figure 8:
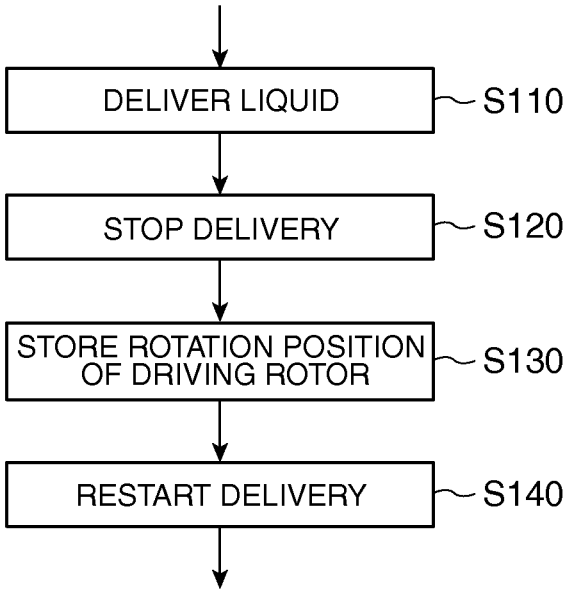
FIG. 8 shows a part of a driving method which includes a mid-course stop.

FIG. 8 shows a part of steps associated with the driving method which includes a mid-course stop. Initially, the fluid transporter 1 is started to continue liquid delivery (S110, corresponding to step S40 in FIG. 7). A delivery stop instruction is inputted from the outside during continuation of liquid delivery to stop liquid delivery (S120). The rotation position of the driving rotor 120 at this time from the rotation reference position is recognized and stored (S130). That is, the rotation angle of the driving rotor 120 from the rotation reference position of the cam 20 as the reference point is stored.

Then, a delivery instruction is inputted from the outside to restart liquid delivery (S140). After this step (S140), the delivery operation is continued from the step S40 to the step S80 in FIG. 7, that is, until the cumulative delivery amount reaches the predetermined delivery amount.

Furthermore, the cumulative delivery amount until the delivery stop is stored by comparison between the data table and the rotation angle of the cam 20 and the rotation angle of the driving rotor 120 at the time of the liquid delivery stop. More specifically, the cumulative delivery amount is read from the data table based on the amount of 1.5 μl multiplied by the count number of the detection markers 30 of the cam 20, and the rotation angle of the driving rotor 120 at the time of the stop from the rotation reference position with reference to Table 1. Then, the respective cumulative delivery amounts are added.

According to the fluid transporter having this structure and its driving method, the projections 22 through 25 press the plural fingers in accordance with the rotation of the cam 20, whereby the fingers perform peristaltic movement to close the tube 50 and deliver liquid. In this case, only a small quantity of liquid reversely flows after release of the engagement between the projections and the fingers and restoration of the tube 50 to the original shape. As a result, the change of the fluid delivery amount with respect to the rotation angle of the cam 20 exhibits a non-linear change within one cycle from the start of the press of the projections against the fingers to the release of the engagement. Thus, the delivery amount cannot be accurately controlled only by detection of the rotation degree of the cam 20.

According to this embodiment, therefore, the data table showing the relationship between the rotation angle of the cam and the cumulative delivery amount measured beforehand is prepared. In this structure, the cumulative delivery amount can be accurately controlled by comparing the rotation angle of the cam 20 detected by the first detecting section and the second detecting section with the data table, and rotating the cam 20 to the rotation position corresponding to the designated cumulative delivery amount (desired delivery amount).

The driving rotor 120 and the cam 20 are connected with each other by the reduction transmission mechanism 2. When the reduction ratio is 1/40, for example, the resolution for detecting the rotation of the cam 20 is 40 times higher than the resolution for detecting the rotation angle of the driving rotor 120 detected by the second detecting sensor 152. In this case, the change of the delivery amount corresponding to the small angle change of the cam 20 can be controlled. Thus, a highly accurate amount can be delivered.

In the structure which detects the rotation angle of the cam 20 from the rotation reference position, the position detected by the first detecting sensor 151 corresponds to the rotation reference position. Thus, when the rotation angle of the driving rotor 120 is detected from this position by the second detecting sensor 152, the cumulative delivery amount corresponding to the rotation angle of the cam 20 can be controlled with high resolution.

When the number of the projections is four, each division has 360/n=90 degrees. In this case, the range shown by the data table is only required to include the cumulative delivery amounts in the range from 0 degree to 90 degrees of the rotation angle of the cam 20. Thus, the data table can be simplified.

It is preferable that the data table contains the cumulative delivery amounts corrected based on the difference between the reference inside diameter and the actual inside diameter of the tube 50. In this case, variations in the delivery amount caused by changes of the tube inside diameter can be reduced.

At the start of the fluid transporter 1, the cam 20 is rotated to the rotation reference position and stopped thereat. Then, delivery is started from the rotation reference position. By this method, the correlation between the cam rotation angle and the cumulative delivery amount can be obtained from the first of the data table.

The rotation angle of the driving rotor 120 at the time of mid-course stop of liquid delivery from the rotation reference position as the reference point is stored. Then, the rotation angle of the driving rotor 120 after the restart of delivery is compared with the data table. By this method, the cumulative delivery amount after the restart of delivery can be accurately detected and controlled.

When liquid delivery is temporarily stopped and restarted, the cumulative delivery amount is read from the data table based on the stored cam rotation angle (count number of the detection markers 30) and the stored rotation angle of the driving rotor 120 from the rotation reference position at the time of the stop. Then, the difference between the read cumulative delivery amount from the data table and the designated cumulative delivery amount is calculated to continue delivery until the cumulative delivery amount reaches the designated cumulative delivery amount.

In case of addition of the delivery amount as only an amount to be controlled, the difference between the added delivery total amount and the amount already delivered as the stored cumulative delivery amount at the time of the stop is calculated, and the cam rotation angle corresponding to the difference of the delivery amount is read from the data table. Then, the driving rotor 120 is rotated based on the result.

Accordingly, in the step of stopping liquid delivery (S120), delivery can be restarted without special operation based on the rotation position of the driving rotor 120 stored with respect to the rotation detection position of the cam 20 as the reference point. Also, the cumulative delivery amount after the restart of delivery can be accurately controlled by comparison between the data table and the cam rotation angle and the cumulative delivery amount.

Second Embodiment

A second embodiment is hereinafter described with reference to the drawings. While the components are disposed substantially in parallel with each other above the first device frame 15 in the first embodiment, in the second embodiment, two units of a drive control unit and a tube unit of the fluid transporter 1 are stacked on each other.

Figure 9:
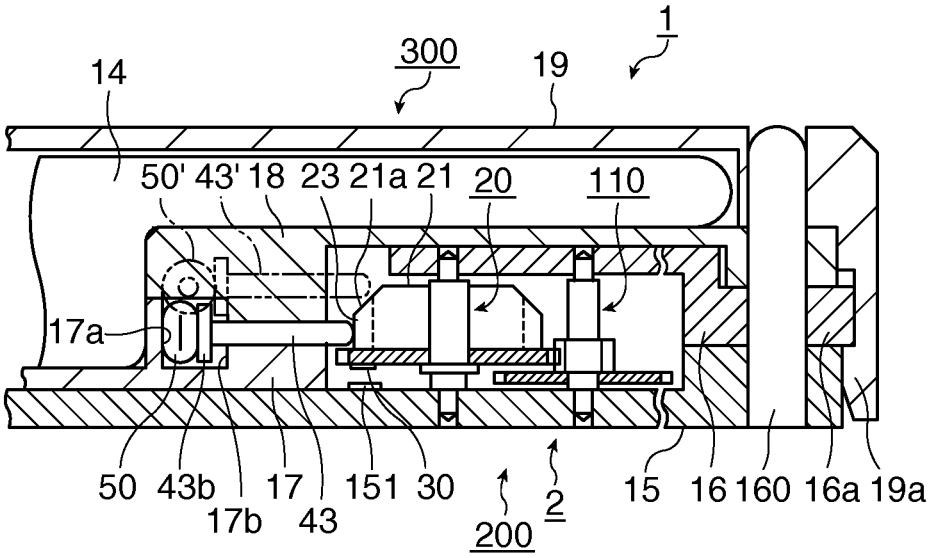
FIG. 9 is a cross-sectional view illustrating a main part of a fluid transporter according to a second embodiment.

FIG. 9 is a cross-sectional view illustrating the main part of the fluid transporter according to the second embodiment. The fluid transporter 1 has a drive control unit 200 and a tube unit 300 stacked on the drive control unit 200. The drive control unit 200 and the tube unit 300 are attachable and detachable to and from each other.

The drive control unit 200 includes the cam 20, the driving rotor 120, the oscillator 130, and the reduction transmission mechanism 2, all of which are held by the first device frame 15 and the second device frame 16. The cam 20, the driving rotor 120, the oscillator 130, and the reduction transmission mechanism 2 are constructed identically to the corresponding components used in the first embodiment (see FIG. 2).

The tube unit 300 includes the tube 50, the fingers 40 through 46 (finger 43 is shown as an example), and the reservoir 14, all of which are held by a third device frame 17, a fourth device frame 18, and a fifth device frame 19. The tube 50 and the fingers 40 through 46 are constructed identically to the corresponding components used in the first embodiment.

As illustrated in FIG. 9, the tube 50 and the fingers 40 through 46 are disposed in the outer circumferential direction of the cam 20, while the most part of the reservoir 14 extends above the drive control unit 200.

A guide slope 21*a* along which the fingers 40 through 46 are guided to slide is provided on the outer circumferential upper surface of the cam body 21 as the rotational pressing plate included in the cam 20. FIG. 9 shows a condition in which the finger 43 is pressed by the projection 23 (corresponding to the finger pressing portion) of the cam body 21 toward the tube 50, in which state the tube 50 is closed between a tube guide wall 17*a* and the finger 43.

Guide shafts 160 are embedded in the first device frame 15. There are provided two or three of the guide shafts 160 away from each other in the outer circumferential direction of the first device frame 15, each shaft of which penetrates through the second device frame 16, the fourth device frame 18, and the fifth device frame 19. Thus, the guide shafts 160 have a function of accurately regulating the planar position of the tube unit 300 with respect to the drive control unit 200.

A plurality of hook engaging portions 16*a* are provided on the outer circumferential surface of the second device frame 16. Hooks 19*a* are provided on the outer circumferential surface of the fifth device frame 19 at positions corresponding to the hook engaging portions 16*a*.

A method for attachment between the drive control unit 200 and the tube unit 300 is now explained with reference to FIG. 9. The tube unit 300 positioned above the drive control unit 200 is attached to the guide shafts 160 from above. When the tube unit 300 is separately disposed, the fingers 40 through 46 are pressed toward the cam 20 by the elasticity of the tube 50 as indicated by an alternate long and two short dashes line in the figure (the position of a finger 43' in the figure). Thus, before completion of attachment of the tube unit 300, the tips of the fingers 40 through 46 contact the guide slope 21*a* of the cam body 21. When the tube unit 300 is pushed downward toward the drive control unit 200, the fingers 40 through 46 slide along the guide slope 21*a* to reach the corresponding projection 23 (finger pressing portion). In this condition, the tube unit 300 is located at a predetermined position with respect to the drive control unit 200.

During attachment of the tube unit 300, the flange 43*b* of the finger 43 is movable until contact with a wall portion 17*b* of the third device frame 17 (to the position represented by the finger 43' in the figure). The guide slope 21*a* is sized larger than the movable range of the fingers.

When the tube unit 300 is attached to the drive control unit 200, the hooks 19*a* provided on the tube unit 300 come into engagement with the hook engaging portions 16*a* provided on the drive control unit 200. As a result, the tube unit 300 and the drive control unit 200 are combined into one body allowed to operate as the fluid transporter 1.

For removing the tube unit 300 from the drive control unit 200, the engagement between the hooks 19*a* and the hook engaging portions 16*a* is released by using a jig or the like.

According to the second embodiment, therefore, the drive control unit 200 and the tube unit 300 are attachable and detachable to and from each other. Thus, after the end of liquid delivery, the tube unit 300 containing new liquid can be attached to the drive control unit 200 to restart liquid delivery in a short time.

Moreover, the drive control unit 200 which includes a larger number of components and is thus expensive can be repeatedly used. On the other hand, the tube unit 300 which includes a smaller number of components and is thus less expensive than the drive control unit 200 can be used as a disposable unit. In this case, the running cost can be lowered.

Furthermore, when the liquid is a liquid medicine used for medical treatment or other purposes, there is a possibility that the tube 50 comes into contact with blood or the like. In this case, the level of safety increases when the tube unit 300 is a disposable unit.

What is claimed is:

1. A method for driving a fluid transporter which includes a tube, a rotational pressing plate with a plurality of detection markers, a plurality of pressing shafts disposed between the tube and the rotational pressing plate, a driving rotor which gives a rotational force to the rotational pressing plate, a first detecting section which detects a rotation angle of the rotational pressing plate, the method comprising:

following a controller receiving a value of a cumulative delivery amount, rotating the rotational pressing plate from a first stopped position and then stopping the rotation at a second stopped position to detect the rotational angle of the rotational pressing plate when the first detecting section detects a detection marker of the plurality of detection markers, a rotation angle between the first stopped position and the second stopped position being less than an angular interval between adjacent detection markers;

initialize the cumulative delivery amount and set the second stopped position as a rotational reference position; and rotating the rotational pressing plate from the rotational reference position, and stopping the rotation when the first detection section detects the rotational angle of the rotational pressing plate corresponding with the cumulative delivery amount.

2. The method for driving a fluid transporter according to claim 1, further comprising:

rotating the rotational pressing plate to start fluid delivery;

allowing the first detecting section to detect the rotation angle of the rotational pressing plate; and rotating the rotational pressing plate through a rotation angle corresponding to a designated cumulative delivery amount and stopping fluid delivery when the rotation angle of the rotational pressing plate reaches the rotational angle corresponding to a designated cumulative delivery amount.

* * * * *